US011542751B2

(12) United States Patent
Tian et al.

(10) Patent No.: US 11,542,751 B2
(45) Date of Patent: Jan. 3, 2023

(54) MULTI-FUNCTION DRILLING TOOL

(71) Applicants: Southwest Petroleum University, Chengdu (CN); Sichuan Jutingzao Technology Co., Ltd., Chengdu (CN)

(72) Inventors: Jialin Tian, Chengdu (CN); Lei Tang, Chengdu (CN); Zhichao Hu, Chengdu (CN); Tongxu Ge, Chengdu (CN); Lin Yang, Chengdu (CN); Chunyu Xing, Chengdu (CN)

(73) Assignees: Southwest Petroleum University, Chengdu (CN); Sichuan Jutingzao Technology Co., Ltd., Chengdu (CN)

( * ) Notice: Subject to any disclaimer, the term of this patent is extended or adjusted under 35 U.S.C. 154(b) by 134 days.

(21) Appl. No.: 17/239,095

(22) Filed: Apr. 23, 2021

(65) Prior Publication Data

US 2022/0186560 A1 Jun. 16, 2022

(30) Foreign Application Priority Data

Dec. 10, 2020 (CN) ..... 202011454304.7

(51) Int. Cl.
*E21B 1/26* (2006.01)
*E21B 4/14* (2006.01)

(52) U.S. Cl.
CPC ..... *E21B 4/14* (2013.01)

(58) Field of Classification Search
CPC ..... E21B 1/24; E21B 1/26; E21B 1/38; E21B 1/12; E21B 6/08; E21B 7/24; E21B 4/02; E21B 4/06; E21B 4/14; E21B 4/16; E21B 6/00
See application file for complete search history.

(56) References Cited

U.S. PATENT DOCUMENTS 2,911,192 A * 11/1959 Boucher ..... E21B 7/24 175/57
3,145,787 A * 8/1964 Brown ..... E21B 6/00 175/107
3,811,515 A * 5/1974 Bazhal ..... E21B 6/08 418/33
2003/0062176 A1* 4/2003 Beccu ..... E21B 4/14 173/93.6

(Continued)

*Primary Examiner* — Kipp C Wallace
(74) *Attorney, Agent, or Firm* — Andrew D. Fortney; Central California IP Group, P.C.

(57) ABSTRACT

A drilling tool is disclosed. The two ends of the drilling tool are respectively connected with an upper drilling tool and a drill bit. The drilling tool includes an axial striking part, a torsional striking part, and an auxiliary part. Under the combined action of a spring and a high-pressure drilling fluid, the hammer of the axial striking part generates an axial striking force to strike the upper housing; and the pendulum of the torsional striking part generates a torsional striking force to strike the lower housing. The reversing switch and the center tube are plugged together to simultaneously reverse torsion and axial striking forces, respectively. The high-pressure drilling fluid pushes the hammer and the pendulum to generate axial and torsional striking forces, respectively, to effectively increase the ROP and reduce the stick-slip phenomenon. The drilling tool is stable and reliable in a complex and changeable downhole environment.

14 Claims, 5 Drawing Sheets

(56) References Cited

U.S. PATENT DOCUMENTS

| | | | | |
|---|---|---|---|---|
| 2005/0241842 | A1* | 11/2005 | Marsh | E21B 4/16 173/13 |
| 2010/0288521 | A1* | 11/2010 | In | E21B 6/08 173/201 |
| 2011/0120725 | A1* | 5/2011 | Downton | E21B 4/06 175/57 |
| 2018/0171717 | A1* | 6/2018 | Chen | E21B 4/006 |
| 2021/0140239 | A1* | 5/2021 | Miess | E21B 4/003 |

* cited by examiner

A-A

B-B

C-C

D-D

E-E

F-F

MULTI-FUNCTION DRILLING TOOL

TECHNICAL FIELD

The present invention belongs to the technical field of petroleum drilling, and it relates to a multi-function drilling tool.

BACKGROUND OF THE INVENTION

With the gradual exhaustion of shallow land oil and gas resources, the development of the deeper wells, the ultra-deep wells and new oil and gas resources has gradually become a trend. In deeper well and ultra-deep well drilling operations, the ROP is low during the drilling process due to the difference of factors such as stratum drill ability, strong rock wear resistance, rock compressive strength and shear strength, etc. In addition, the elongated drill string system is prone to stick-slip phenomenon, which reduces the efficiency of drilling operations. The existing downhole striking tools are basically a single axial hammer or a single torsional hammer, and their use is effects are general.

Therefore, how to simultaneously generate axial and torsional striking forces to increase the ROP and reduce the stick-slip phenomenon of the drill string system is a key technical problem that this field is eager to solve.

SUMMARY OF THE INVENTION

The purpose of this invention is to provide a drilling tool that can simultaneously generate the axial and torsional striking forces to increase the rate of penetration (ROP) and reduce the stick-slip phenomenon.

In order to achieve the above-mentioned purpose of the invention, a drilling tool, comprising: an axial striking part, a torsional striking part and an auxiliary part; the two ends of the drilling tool are detachably threads connected with the upper drilling tool and the drill bit, respectively.

The axial striking part comprises a hammer that is located inside the upper housing and generates a striking force, a center tube and an intermediate tube that control the movement and reverse the direction of the hammer, a fixing block inserted into the upper end of the intermediate tube, an adjustment screw assembled on the upper housing and a spring between the fixing block and the hammer; the hammer of the axial striking part reciprocally strikes the upper housing to generate an axial striking force up and down.

The torsional striking part comprises a pendulum that is mounted inside the lower housing and generates a torsional striking force to strike the lower housing, a reversing switch for turning direction of the pendulum, an upper end cover and a lower end cover assembled respectively on the upper and lower ends of the pendulum.

The auxiliary part comprises an upper connector coupled to the upper drilling tool, an upper connector connected with the drill bit, and a nozzle is that generates a variable pressure cavity.

Preferably, the inside and outside of the hammer are in clearance fit with the intermediate tube and the upper housing, respectively; the hammer is coaxial with both the intermediate tube and the upper housing.

Preferably, the center tube is configured with the holes a, the holes b, and the holes c; the center tube is coaxial with the intermediate tube designed with the holes d and the holes e.

Preferably, the couple holes a, the couple holes b, the couple holes d and the couple holes e are symmetrically configured, respectively. The axis of the holes a are parallel to the holes b. The four holes c are evenly distributed; and a certain phase difference is between the axis of the holes d and the axis of the holes e.

Preferably, the inside of the fixing block is inserted into the intermediate tube, the outside of the fixing block is a gear structure. The adjustment screw assembled on the upper housing limits the circumferential direction of the fixing block, and the upper connector limits the axial direction of the fixing block. The two ends of the spring implemented pre-pressure by the upper connector are against the fixing block and the hammer, respectively.

Preferably, the reversing switch is connected with the connection point of the center tube; and the center tube rotates to change direction with the reversing switch together when the reversing switch works. Both the center tube and the inside of the lower end cover are configured with nozzles, and the shoulders of the center tube and the shoulders of the lower end cover and the retainer ring limit the nozzles axially. The lower end cover is fixed in the inside of the lower housing by the end cover screws.

Preferably, the reversing switch is designed with a couple of symmetrical flow channels a. the reversing switch above the upper end cover is configured with two-layer holes f, and each layer has four holes f evenly distributed. The pendulum is configured with a couple of symmetrical fluid channels e, a couple of symmetrical fluid channels f, a couple of symmetrical fluid channels g and a couple of symmetrical fluid channels h; the inside of the lower housing has a fluid channels b and a fluid channels c. The lower end cover has a couple symmetric fluid channels j and a couple symmetric fluid channels k.

Preferably, the front end and the rear end of the reversing switch are configured with the grooves suitable for balls c, respectively. The upper end and the lower end of the pendulum are configured with the arc grooves equipped with the balls b at a lower end of the upper end cover and the balls c at an upper end of the lower end cover, respectively.

Preferably, the pendulum comprises the inside and the outside coupled to the reversing switch and the lower housing, respectively, which is coaxial with the reversing switch and the lower housing both. the upper end cover blocks the upper end of the flow channel c, and the lower end of the flow channel c is in communication with the flow channel j; the lower end cover blocks both the lower end of the flow channel b and the flow channel d.

Preferably, the outer walls of the upper connector, the upper housing, the lower housing and lower connector are configured with the spiral grooves, respectively. The upper connector is connected with the upper housing mounted with the lower housing coupled with the lower connector used threads together by threads.

The invention may have the following beneficial effects: it is a purely mechanical structure and not liable to fail in a complex and changeable downhole environment. It uses drilling fluid to generate axial and torsional is striking forces at the same time, effectively increasing the ROP and reducing the stick-slip phenomenon of the drill string system.

BRIEF DESCRIPTION OF THE DRAWINGS

Some embodiments of the invention will be explained in greater detail in the attached drawings.

Some embodiments of the invention are shown simplified for the sake of clarity in the drawings. Same reference numerals refer to same parts in the is figures. The drawings are not drawn to the actual scale.

The meanings of the reference signs in the attached drawings are as follows: 1—upper connector, 2—sealing ring a, 3—fixing block, 31—gear structure, 4—spring, 5—center tube, 51—holes a, 52—holes b, 53—holes c, 6—hammer, 7—intermediate tube, 71—holes d, 72—holes e, 8—sealing ring b, 9—upper housing, 10—balls a, 11—reversing switch, 111—hole f, 112—flow channels A, 1115*a*—cavity a, 1115*b*—cavity b, 1115*c*—cavity c, 12—upper end cover, 13—balls B, 14—lower housing, 141—flow channels b, 142—flow channels c, 143—flow channels d, 1415*a*—cavity d, 1415*b*—cavity b, 15—pendulum, 151—flow channels e, 152—flow channels f, 153—flow channels g, 154—flow channels h, 16—balls c, 17—spring retainer, 18—nozzles, 19—lower end cover, 191—flow channels j, 192—flow channels k, 20—upper connector, 21—adjustment screw, 22—end cover screw.

DETAILED DESCRIPTION OF THE INVENTION

The invention will be further explained below in conjunction with the drawings.

Figure 1:
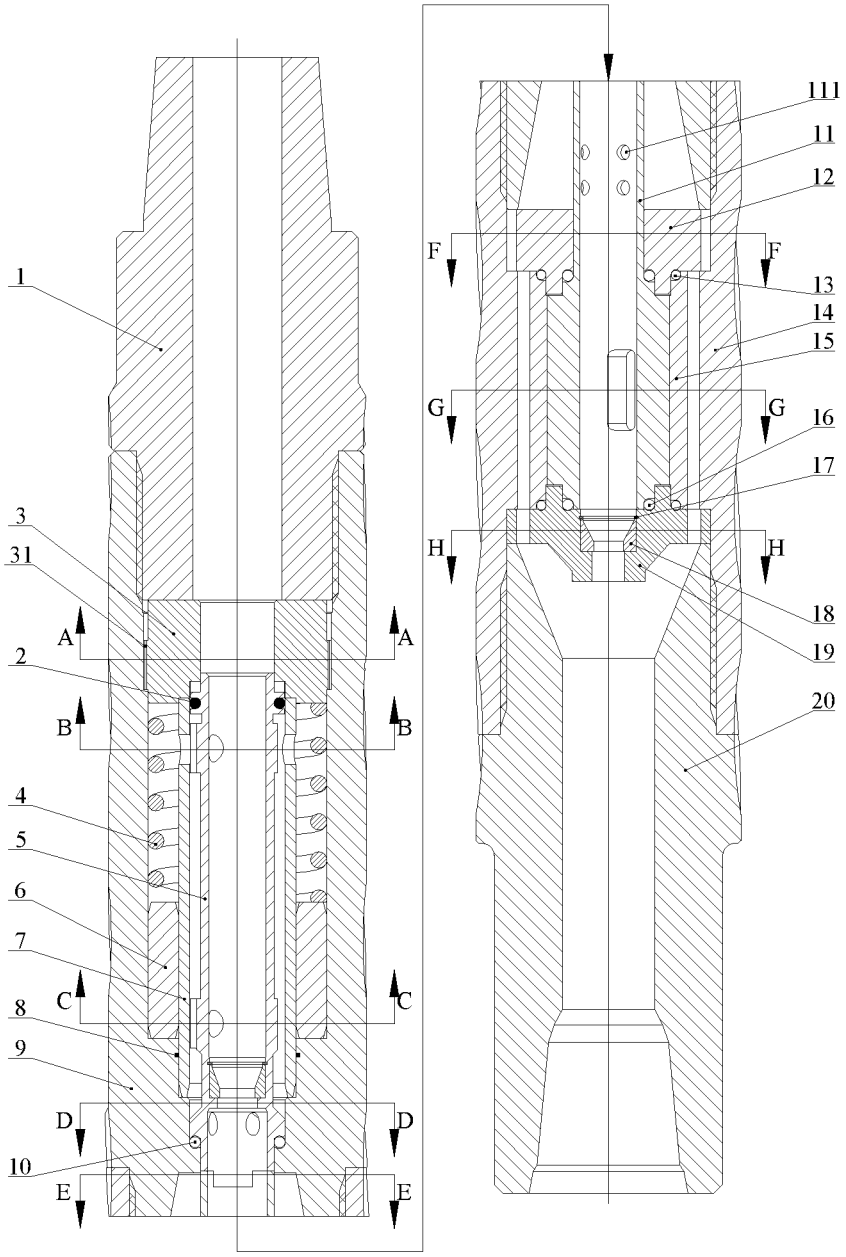
FIG. 1 is a schematic diagram of the drilling tool according to an embodiment of the present invention.

FIG. 1 discloses schematically a drilling tool according to an embodiment of the invention. It should be illustrated that the drawings of the present invention are applied to the oil drilling industry, and it does not limit current application to this. In the embodiment in petroleum drilling as an example, the two ends of the drilling tool are connected by threads, which is convenient for disassembly and assembly. The axial striking part of the drilling tool comprises a hammer 6 located in the inside of the upper housing 9 to generates an axial striking force, a center tube 5 and an intermediate tube 7 that move and reverse the direction of the hammer 6, the fixing block 3 inserted into the upper end of the intermediate tube 7, a spring 4 between the fixing block 3 and the hammer 6, and an adjustment screw 21 assembled on the upper housing 9. The hammer 6 strikes the upper housing 9 up and down to generate an axial striking force, reciprocally. The torsional striking part comprises a pendulum 15 that is located the inside of the lower housing 14 and generates a striking force, a reversing switch 11 for changing the direction of the pendulum 15, an upper end cover 12 and a lower end cover 19 assembled on the upper and lower ends of the pendulum 15, respectively. The pendulum 15 of the torsional striking part produces a torsional striking force to strike the lower housing 14, torsionally and reciprocally. The auxiliary part comprises an upper connector 1 connected with the upper drilling tool, an upper connector 20 coupled to a drill bit, and a nozzle 18 to produce a pressure drop.

In a preferred embodiment shown in FIG. 1, The inner and outer parts of the hammer 6 are in clearance fit with the intermediate tube 7 and the upper housing 9 respectively; the hammer 6 is coaxial with the intermediate tube 7; the hammer 6 is coaxial with the upper housing 9, and the hammer 6 is sleeved on the intermediate tube 7 and can slide in the axial direction.

Figure 3:
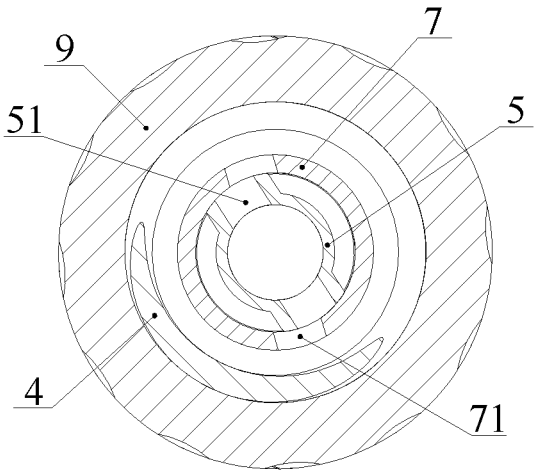
FIG. 3 is a B-B cross-sectional view of FIG. 1, which is about the axial holes a51 of the center tube 5 and the axial holes d71 of the intermediate tube 7.
Figure 4:
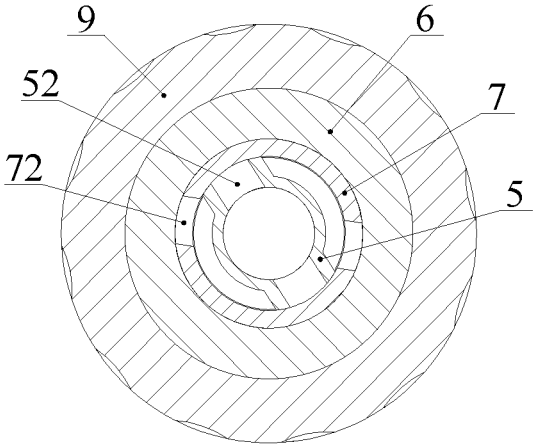
FIG. 4 is a C-C cross-sectional view of FIG. 1, which is about the axial holes b52 of the center tube 5 and the axial holes e72 of the intermediate tube 7.
Figure 5:
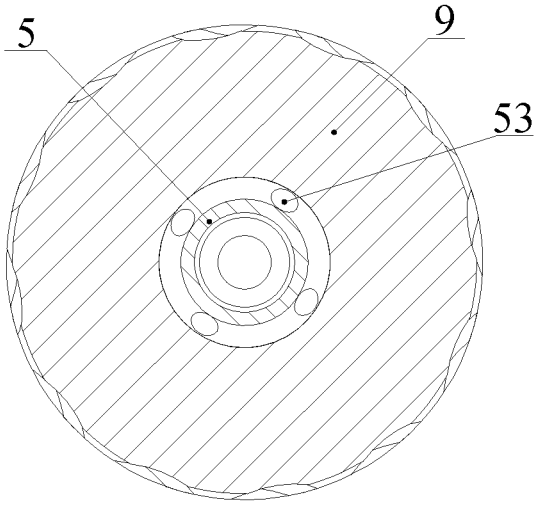
FIG. 5 is a D-D cross-sectional view of FIG. 1, which is with regard to the four pressure relief holes c 53 uniformly distributed in the center tube 5.

As shown in FIG. 3, FIG. 4 and FIG. 5, the center tube 5 configured with the holes a 51, b 52 and c 53 is coaxial with the intermediate tube 7 designed with the holes d 71 and e 72*e*. Further, a couple of holes a 51, holes b 52, holes d 71 and holes e 72 are symmetrically configured, respectively. The axis of the holes a 51 is paralleled with the holes b 52; the four holes c 53 are evenly distributed; a certain phase difference is at between the axis of the holes d 71 and the axis of the holes e 72. The intermediate tube 7 restricts the rotation under the action of the fixing block 3 and the adjustment screw 21 during the center tube 5 rotation, and the high-pressure drilling fluid alternately enters the upper and lower ends of the hammer 6 to push the hammer 6 reciprocated axially to achieve axial striking force.

Figure 2:
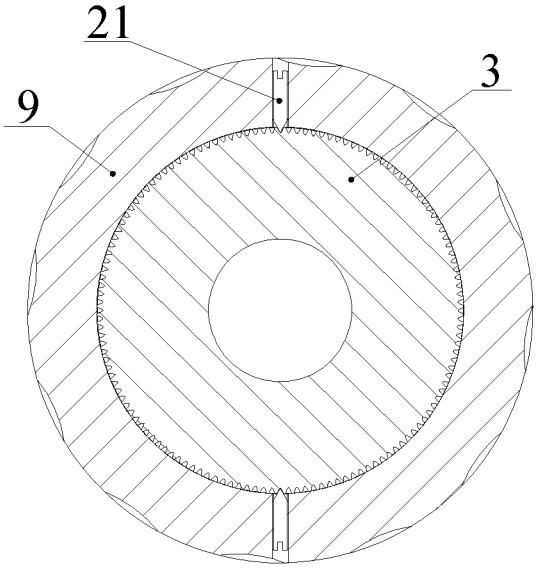
FIG. 2 is an A-A cross-sectional view of FIG. 1, which is about the external gear structure 31 on the fixing block 3 restricting the circumferential movement by the adjustment screw 21.

One embodiment shown in FIGS. 1 and 2 discloses the fixing block 3 which includes the inside inserted into the intermediate tube 7 and the outside being a gear structure 31. The circumferential direction of the fixing block 3 is limited by an adjustment screw 21 assembled on the upper housing 9 associated with the lower housing 14 by threads. The gear structure 31 and the adjustment screw 21 are used to adjust the appropriate circumferential position of the intermediate tube 7. The two ends of the spring 5 implemented pre-pressure by the upper connector 1 support the fixing block 3 and the hammer 6, respectively. The spring 5 acts as a buffer when the hammer 6 moves upward in the axial direction to avoid striking force opposite to the drilling direction or when the hammer 6 moves downward in the axial direction to generate the additional thrust.

Figure 6:
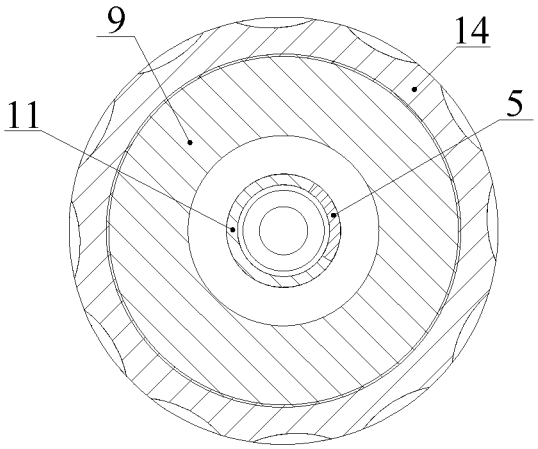
FIG. 6 is an E-E cross-sectional view of FIG. 1, which is about the center tube 5 being plugged into the reversing switch 11.
Figure 9:
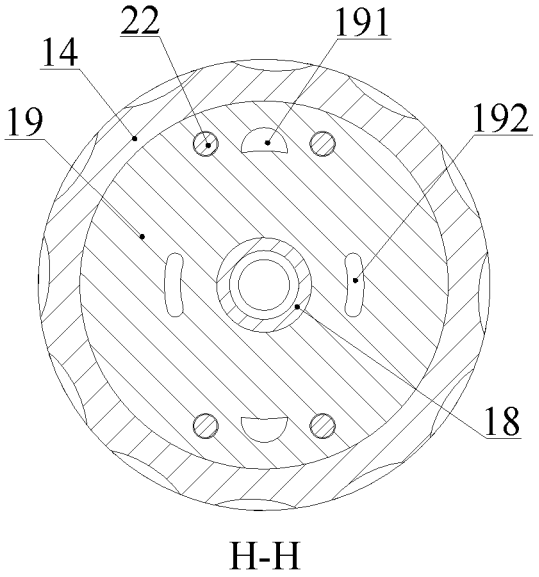
FIG. 9 is a H-H cross-sectional view of FIG. 1.

With reference to FIG. 1, FIG. 6 and FIG. 9, one embodiment of the reversing switch 11 associated with the connection point of the center tube 5 is illustrated. The reversing switch 11 rotates to change direction with the center tube 5 together during the reversing switch 11 operates. The center tube 5 reverses the axial striking force while the reversing switch 11 reverses the torsional striking force, the nozzle 18 located between the center tube 5 and the lower end cover 19 is axially restricted by the shoulders of the center tube 5 and the shoulders of the lower end cover 19 and the spring retainer ring 17. Drilling fluid generates the pressure drop to push the hammer 6 and the pendulum 15 to move during the drilling fluid flow through the nozzle 18. The lower end cover 19 is fixed in the inside of the lower housing 14 by the end cover screw 22.

FIG. 1 to FIG. 8 disclose the reversing switch 11 configured with a couple of symmetrical flow channels a 112. The reversing switch 11 above the upper end cover 12 is configured with two-layer holes f 111, and each is layer has four holes f 111 evenly distributed. The pendulum 15 is designed with a couple of symmetrical fluid channels e 151, a couple of symmetrical fluid channels f 152, a couple of symmetrical fluid channels g 153 and a couple of symmetrical fluid channels h 154; the inside of the lower housing 14 has a fluid channel b 141 and a fluid channel c 142; the lower end cover 19 has a couple of symmetric fluid channels j 191 and a couple of symmetric fluid channels k 192.

Preferably, FIG. 1 discloses the front end and the rear end of the reversing switch 11 configured with the grooves suitable for balls 16, respectively; the upper end and the lower end of the pendulum 15 are configured with the arc grooves equipped with the balls 13 at a lower end of the upper end cover 12 and the balls 16 at an upper end of the lower end cover 19, respectively. The ball 13 and the ball 16 are used to reduce friction during the reversing switch 11 and the pendulum 15 rotation operation.

In a preferred embodiment as shown in FIG. 1, FIG. 7, FIG. 8 and FIG. 9, the pendulum 15 comprises the inside and outside coupled to the reversing switch 11 and the lower housing 14 in clearance fit, respectively, which is coaxial with the reversing switch 11 and the lower housing 14; the upper end cover 12 blocks the upper end of the flow channel c 142, and the lower end of the flow channel c 142 is coupled to the flow channel j 191; the lower end covers 19 blocks both the lower ends of the flow channels b 141 and the flow channels d 143.

In a preferred embodiment illustrated in FIG. 1, the outer walls of the upper connector 1, the upper housing 9, the lower housing 14 and lower connector 20 are all configured with the spiral grooves, respectively; the upper connector 1 and the upper housing 9, the upper housing 9 and the lower housing 14, and the lower housing 14 and the lower connector 20 are is connected together by threads.

Figure 7:
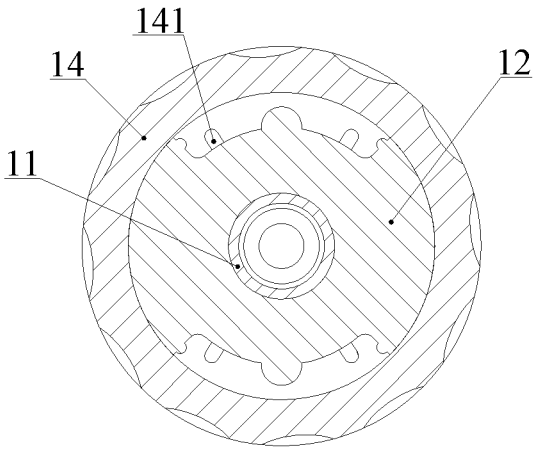
FIG. 7 is a F-F cross-sectional view of FIG. 1, which is with respect to the upper end cover 12.
Figure 8:
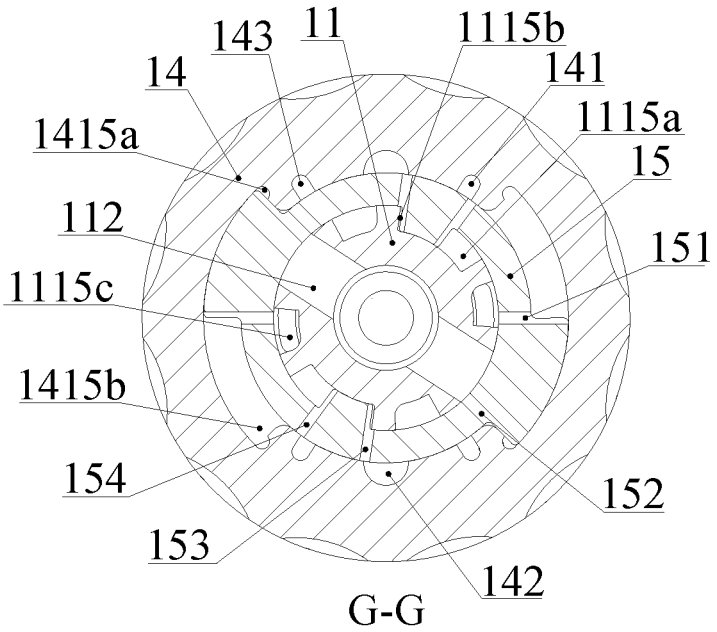
FIG. 8 is a G-G cross-sectional view of FIG. 1, which is about the torsional striking part.

The following takes FIGS. 1 to 9 as examples to introduce the working process of the drilling tool. FIG. 2 is a schematic sectional view of the external gear structure 31 on the fixing block 3 restricting the circumferential movement by the adjustment screw 21; FIG. 3 is sectional schematic diagrams of the axial holes a 51, d 71 about the center tube 5 and the intermediate tube 7, and FIG. 4 is sectional schematic diagrams of the axial holes b 52, e 72 about the center tube 5 and the intermediate tube 7, respectively; FIG. 5 is a schematic diagram of the four pressure relief holes c 53 uniformly distributed in the center tube 5; FIG. 6 is a schematic diagram of the center tube 5 being plugged into the reversing switch 11; FIG. 7 is a schematic sectional view of the upper end cover 12; FIG. 8 is a schematic sectional view of the torsional striking part; FIG. 9 is a schematic sectional view of the lower end cover 19.

The torsional striking process of the drilling tool is as following: the upper connector 1 is connected to the drill string. The high-pressure drilling fluid is injected through the drill string. The high-pressure drilling fluid sequentially flows through the hole f 111 of the reversing switch 11, the flow channel b 141 of the lower housing 14, and the flow channel h 154 of the pendulum 15, which enters the cavity a 1115*a* and pushes the reversing switch 11 to rotate clockwise. At the same time, the low-pressure drilling fluid in the cavity b 1115*b* flows back to the upper connector 20 through the flow channel g 153 of the pendulum 15, the flow channel c 142 of the lower housing 14, and the flow channel j 191 of the lower end cover 19 in turn. As shown in FIG. 8, the flow channel a 112 of the reversing switch 11 communicates with the flow channel f 152 of the pendulum 15 when the reversing switch 11 rotates clockwise to the limit, and the high-pressure is drilling fluid enters the cavity d 1415*a* to rotate the pendulum 15 counterclockwise. In this process, the pendulum 15 drives the reversing switch 11 to rotate counterclockwise together; at the same time, the low-pressure drilling fluid in the cavity e 1415*b* flows back to the upper connector 20 through the flow channel e 151 of the pendulum 15, the cavity c 1115*c*, and the flow channel k 192 of the lower end cover 19 in turn. When the pendulum 15 strikes the lower casing 14 counterclockwise, the high-pressure drilling fluid in the flow channel d 143 enters the cavity b 1115*b* through the flow channel g 153 to rotate the reversing switch 11 counterclockwise, the high-pressure drilling fluid enters the cavity e 1415*b* to the pendulum 15 rotate counterclockwise when the flow channel a 112 is connected to the flow channel e 151. In this process, the pendulum 15 drives the reversing switch 11 until the pendulum 15 impacts the lower housing 14 clockwise. Thus, the pendulum 15 reciprocates, generating the torsional impact.

The axial impact process of the drilling tool is as following: the upper connector 1 is connected to the drill string. The high-pressure drilling fluid is injected through the drill string. The holes a 51 and d 71 are being low-pressure during the pendulum 15 drives the reversing switch 11 to rotate counterclockwise together resulting in the center tube 5 to rotate counterclockwise. The low-pressure drilling fluid at the upper end of the hammer 6 is enters the annulus low-pressure zone between the center tube 5 and the intermediate tube 7 through hole d 71. The high-pressure drilling fluid enters the lower end of the hammer 6 through holes b 52 and hole e 72 to push hammer 6 compressing spring 4 upward in the axial direction when hole b 52 is in communication with holes e 72. On the other hand, the hole a 51 is connected to the hole d 71 as the pendulum 15 drives the reversing is switch 11 to rotate clockwise together so that the center tube 5 rotates clockwise, and the high-pressure drilling fluid enters the upper end of the hammer 6 through the holes a 51 and d 71, and together with the spring 4, push the hammer 6 down in the axial direction and impact the upper housing 9. The low-pressure drilling fluid at the lower end of the hammer 6 communicates with the annulus low pressure zone between the center tube 5 and the intermediate tube 7 through the hole e 72 when the holes b 52 and the holes e 72 are closed. The hammer 6 reciprocates in line to produce the axial striking force in this way.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology. The present invention is not limited to the specific embodiments disclosed in the text, but includes all technical solutions falling within the scope of the claims.

What is claimed is:

1. A multi-function drilling tool, comprising:

an axial striking part that includes an upper housing, a hammer configured to generate a strike, a center tube and an intermediate tube that move and reverse a direction of the hammer, a fixing block on the intermediate tube, an adjustment screw on the upper housing, and a spring between the fixing block and the hammer, wherein the hammer reciprocally strikes the upper housing by moving up and down to generate an axial striking force;

a torsional striking part that includes a pendulum in a lower housing, a reversing switch configured to turn the pendulum, an upper end cover and a lower end cover on upper and lower ends of the pendulum, respectively, wherein the pendulum striking part torsionally and reciprocally strikes the lower housing to produce a torsional striking force; and an auxiliary part that includes an upper connector configured to be connected with an upper drilling tool, a lower connector configured to be connected with a drill bit, and a nozzle in fluid communication with a variable-pressure cavity.

2. The drilling tool as in claim 1, wherein the hammer is in a clearance fit with the intermediate tube and the upper housing, respectively; and the hammer is coaxial with both the intermediate tube and the upper housing.

3. The drilling tool as in claim 1, wherein the center tube includes first holes, second holes and third holes; the intermediate tube includes fourth holes and fifth holes; and the center tube is coaxial with the intermediate tube.

4. The drilling tool as in claim 3, wherein: the first holes, the second holes, the fourth holes and the fifth holes are symmetrically configured; the first holes have an axis parallel to the second holes; the third holes are evenly distributed; and the fourth holes and the fifth holes have axes with a certain phase difference therebetween.

5. The drilling tool as in claim 1, wherein the fixing block is connected to the intermediate tube, the fixing block comprises a gear structure, the adjustment screw limits circumferential movement of the fixing block, the upper connector limits axial movement of the fixing block, and the spring has a first end against the fixing block and a second end against the hammer.

6. The drilling tool as in claim 1, wherein the reversing switch is connected with a connection point of the center tube; when the reversing switch operates, the center tube rotates to change direction with the reversing switch; the center tube and the lower end cover are each in fluid communication with the nozzle; the drilling tool further comprises a retainer ring and end cover screws; the center tube, the lower end cover, and the retainer ring axially limit the nozzle; and the end cover screws fix the lower end cover in the lower housing.

7. The drilling tool as in claim 1, wherein the reversing switch includes symmetrical first flow channels; the reversing switch includes layer holes above the upper end cover, and the layer holes and evenly distributed; the pendulum includes two symmetrical first fluid channels, two symmetrical second fluid channels, two symmetrical third fluid channels and two symmetrical fourth fluid channels; the lower housing has fifth fluid channels and sixth fluid channels; and the lower end cover has two symmetrical seventh fluid channels and two symmetrical eighth fluid channels.

8. The drilling tool as in claim 1, wherein the reversing switch has a front end and a rear end with the grooves suitable for first balls; and the pendulum has an upper end with a first arc groove equipped with second balls at a lower end of the upper end cover and a lower end with a second arc groove equipped with third balls at an upper end of the lower end cover.

9. The drilling tool as in claim 1, wherein the pendulum is coupled to the reversing switch and the lower housing in a clearance fit, the pendulum is coaxial with the reversing switch and the lower housing, the upper end cover blocks an upper end of second flow channels, and a lower end of the second flow channels is coupled to third flow channels, and the lower end cover blocks lower ends of fourth flow channels and fifth flow channels.

10. The drilling tool as in claim 1, wherein the upper connector, the upper housing, the lower housing and lower connector have outer walls with spiral grooves; and the upper connector is connected with the upper housing, the upper housing is connected with the lower housing, and the lower housing is coupled with the lower connector by screw threads.

11. The drilling tool as in claim 1, wherein the intermediate tube has an upper end, and the fixing block is on the upper end of the intermediate tube.

12. The drilling tool as in claim 1, wherein the adjustment screw is affixed to the upper housing.

13. The drilling tool as in claim 1, wherein:

The upper connector has a first end having a first screw thread configured to detachably connect to the upper drilling tool, and the lower connector has a second end having a second screw thread configured to detachably connect to the drill bit.

14. The drilling tool as in claim 1, wherein the spring is configured to implement pre-pressure from the upper connector.

* * * * *